US005870085A

United States Patent [19]

Laksono

[11] Patent Number: 5,870,085

[45] Date of Patent: Feb. 9, 1999

[54] GENERATING TEXT STRINGS

[75] Inventor: Indra Laksono, Richmond Hill, Canada

[73] Assignee: ATI International

[21] Appl. No.: 792,772

[22] Filed: Feb. 3, 1997

[51] Int. Cl.[6] ..... G09G 5/22

[52] U.S. Cl. ..... 345/192; 345/511; 345/523; 345/467

[58] Field of Search ..... 345/192–195, 345/467–469, 508, 511, 523

[56] References Cited

U.S. PATENT DOCUMENTS 5,590,260 12/1996 Morse et al. ..... 345/192

*Primary Examiner*—Kee M. Tung

*Attorney, Agent, or Firm*—Markison & Reckamp

[57] ABSTRACT

A rasterizer is used with a system capable of furnishing raster data representative of a string of characters to be formed on a display. The rasterizer has an input interface that is connected to receive the raster data from the system. A graphics engine is connected to use the raster data to simultaneously store representations of portions of at least two of the characters in a memory. An output interface is connected to use the representations stored in the memory to form an output signal which is used by the display to form the characters.

6 Claims, 9 Drawing Sheets

| | | | |
|---|---|---|---|
| 1 | 0 | 0 | 0 |
| 1 | 0 | 0 | 0 |
| 1 | 0 | 0 | 0 |
| 1 | 0 | 1 | 0 |
| 1 | 1 | 0 | 1 |
| 1 | 0 | 0 | 1 |
| 1 | 0 | 0 | 1 |
| 1 | 0 | 0 | 1 |
| 1 | 0 | 0 | 1 |

GENERATING TEXT STRINGS

BACKGROUND OF THE INVENTION

The invention relates to generating text strings.

As shown in FIG. 1, to display a text character (e.g., an "h" 17) on a display 16, a central processing unit (CPU) 25 of a computer system 12 typically generates both monochrome raster data 11 defining the character and an address specifying the location on the display 16 at which the character should appear. A rasterizer 14 uses the raster data 11 and address to generate analog signals (e.g., RGB signals) which cause the character to appear at the desired location on the display 16.

As shown in FIG. 2, the raster data 11 directs the placement of foreground pixels (each pixel having a predetermined foreground color) of the character on the display 16 by defining a bit mask for a corresponding block 23 of pixels. One bit value (e.g., a logical one) sets the color of a corresponding pixel equal to a predetermined foreground color, and another bit value (e.g., a logical zero) leaves the color of the corresponding pixel unchanged (i.e., the background of the character is transparent). The size of the character (i.e., the width (in pixels) and height (in pixels) of the pixel block 23) is a function of a user selected character size, and the particular mask defined by the raster data 11 is a function of a user selected font.

The rasterizer 14 typically has a graphics engine 10 (FIG. 1) which stores a color value (e.g., a sixteen bit representation of the color of a pixel) for each foreground pixel of the character in a frame buffer 13 (FIG. 3). The frame buffer 13 typically is organized by subregions 30 with each subregion 30 containing color values (representative of foreground and background pixel colors) associated with a horizontal scan line (typically one pixel high and 1024 pixels wide) of the display 16. Thus, a character to be displayed is stored in a region 31 of the frame buffer 13 that includes portions of several subregions 30 (i.e., the character is drawn using several scan lines). As an example, for a character having a width of four pixels and a height of nine pixels, one subregion 30*a* contains four color values associated with the top line of the character, and one subregion 30*b* has four color values associated with the bottom line of the character. A digital-to-analog converter (DAC) 21 regularly receives the color values from the frame buffer 13 and uses the color values of each subregion 30 to generate one of the scan lines.

The rasterizer 14 typically draws a text string (e.g., a string "hello" 27 in FIG. 1) on the display 16 one character at a time. For example, to draw the string "hello," the graphics engine 10 first transfers the color values associated with the character "h" to the display 16. As a result, the character "h" appears on the display 16 (FIG. 4A). Next, the graphics engine 10 transfers the color values associated with the character "e" to the frame memory 13. As a result, the character "e" appears on the display 16 (FIG. 4B). The graphics engine 10 continues this process until all color values associated with the string are stored in the frame buffer 13, and as a result, the entire string appears on the display 16.

The memory cells of the frame buffer 13 typically are arranged in rows (often referred to as pages) and columns. Before one of the rows is accessed (read from or written to), the row must be precharged which introduces a delay (often referred to as a page fault delay) in accessing the row. Due to this required precharging, successive accesses to the same row (i.e., accesses that remain in the same page) require less time than successive accesses to different rows (i.e., no page fault delays for successive accesses to the same row).

The graphics engine 10 typically has to access several different pages in the frame buffer 13 to transfer the color values for one character. As an example, for a sixteen bit color value and a page size of four kilobytes, only the color values associated with two lines of the character are contained within one page (i.e., only two subregions 30 per page). As a result, when transferring the color values for a character to the frame buffer 13, the graphics engine 10 must access a different page (i.e., a page fault delay is introduced) for every two lines of the character.

SUMMARY OF THE INVENTION

The invention provides a rasterizer that draws a text string one line at a time instead of one character at a time. In this manner, the color values associated with each line are grouped together and stored in one page of the frame buffer, and the color values may be transferred in blocks to contiguous portions of the frame buffer. As a result, memory access delays (e.g., page fault delays) are reduced, and the rate at which the text string is drawn is maximized.

In general, in one aspect, the invention features a rasterizer for use with a system capable of furnishing raster data representative of a string of characters to be formed on a display. The rasterizer has an input interface that is connected to receive the raster data from the system and a graphics engine. The graphics engine uses the raster data to simultaneously store representations of portions of at least two of the characters in a memory (e.g., a frame buffer). An output interface is connected to use the representations stored in the memory to form an output signal which is used by the display to form the characters.

In preferred embodiments, the graphics engine is connected to store the representations in a contiguous portion (e.g., a page) of the memory. The display has scan lines for forming the characters, and the display is configured to use one of the scan lines to form the portions. The representations include values indicative of an attribute (e.g., a foreground color) of the string. The system furnishes the raster data for one character at a time, and the rasterizer has a buffer in which the graphics engine stores the raster data for the characters. The graphics engine uses the raster data stored in the buffer to store the representations in the memory. The graphics engine stores the raster data in the buffer in the order the raster data is received from the system. The raster data for each character has subsets of data, and each subset of data is associated with a scan line of the display. The graphics engine simultaneously stores at least two of the subsets of data in the buffer.

In general, in another aspect, the invention features a method for use with a system capable of furnishing raster data representative of a string of characters to be formed on a display. The raster data is received from the system and used to simultaneously store representations of portions of at least two of the characters in a memory. The representations stored in the memory are then used to form an output signal used by the display to form the characters.

Other advantages and features will become apparent from the following description and from the claims.

DESCRIPTION OF THE PREFERRED EMBODIMENTS

Figures 1, 2:
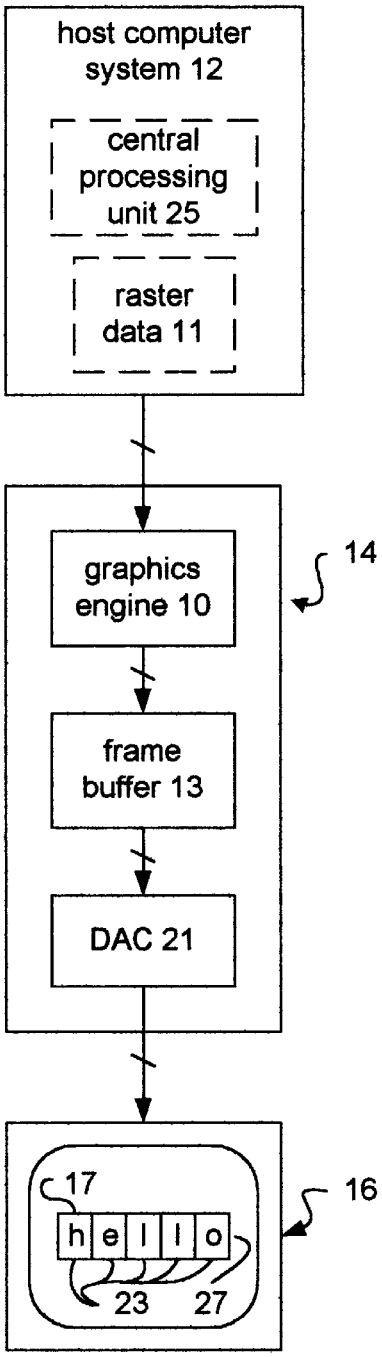
FIG. 1 (PRIOR ART)
FIG. 2 (PRIOR ART)
FIG. 1 is a block diagram of a graphics system of the prior art.
FIG. 2 is a chart illustrating monochrome raster data for a text character.
Figure 3:
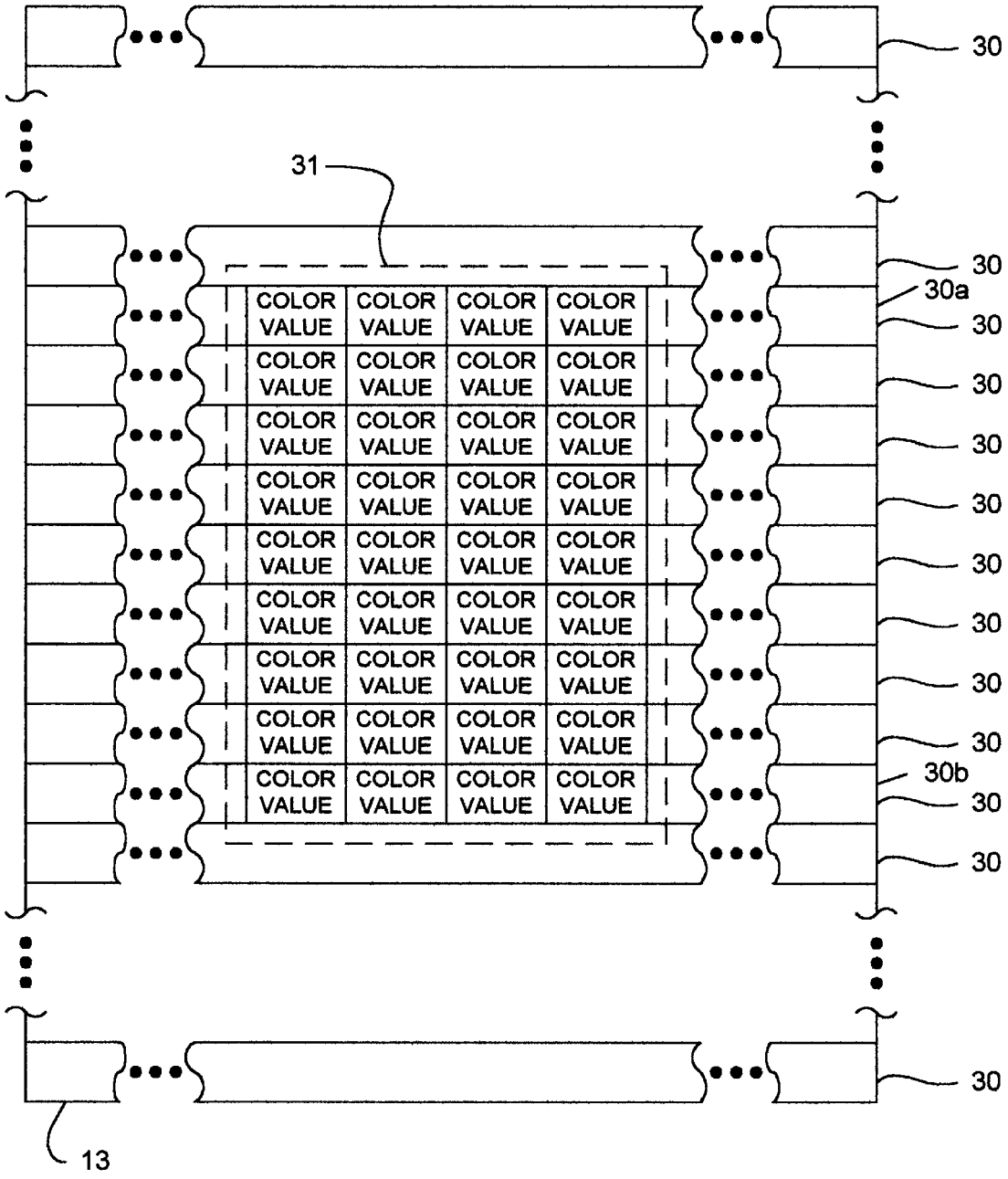
FIG. 3 (PRIOR ART)
FIG. 3 is an organizational map of a frame buffer of the graphics system of FIG. 1.
Figure 4A:
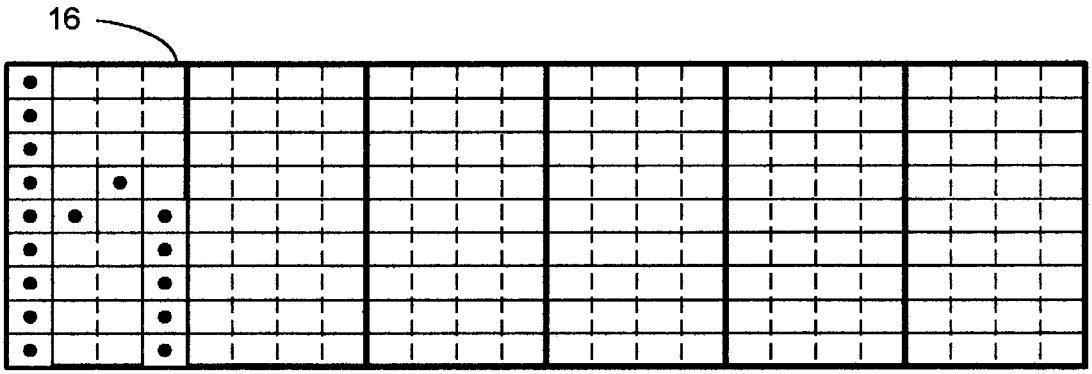
FIGS. 4A–C are views of the display showing the generation of a text string by the graphics system of FIG. 1.
Figure 4B:
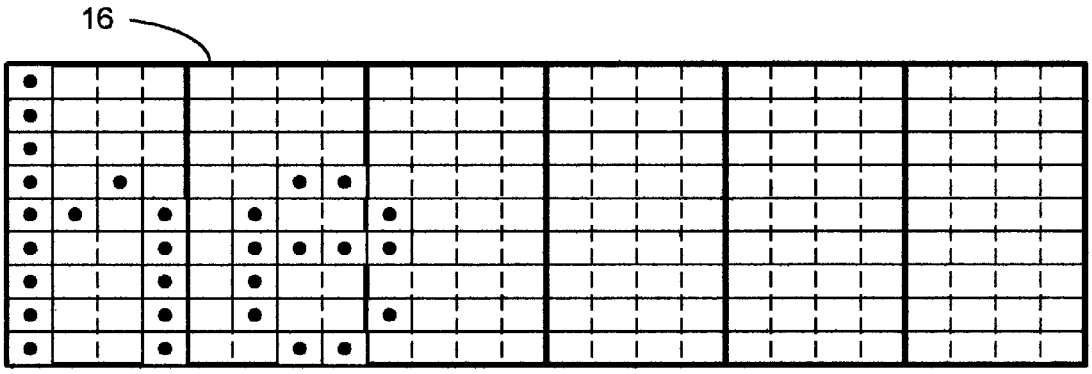
Figure 4C:
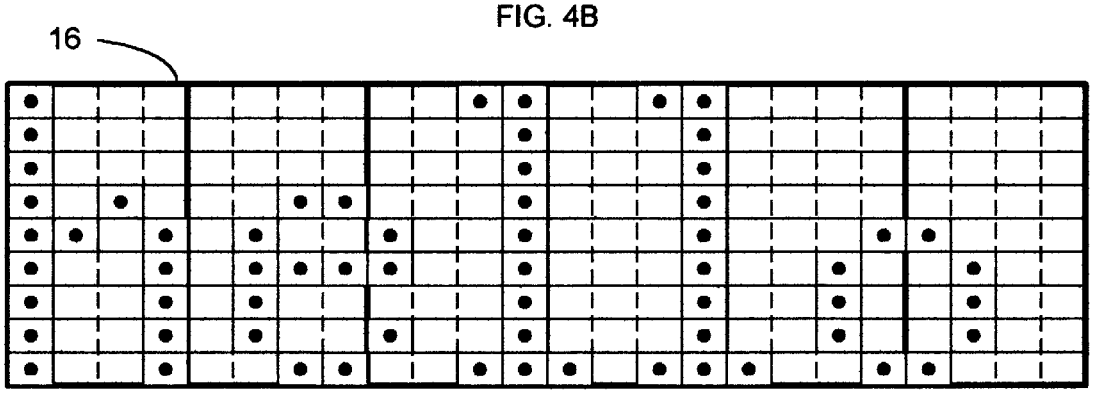
Figure 5A:
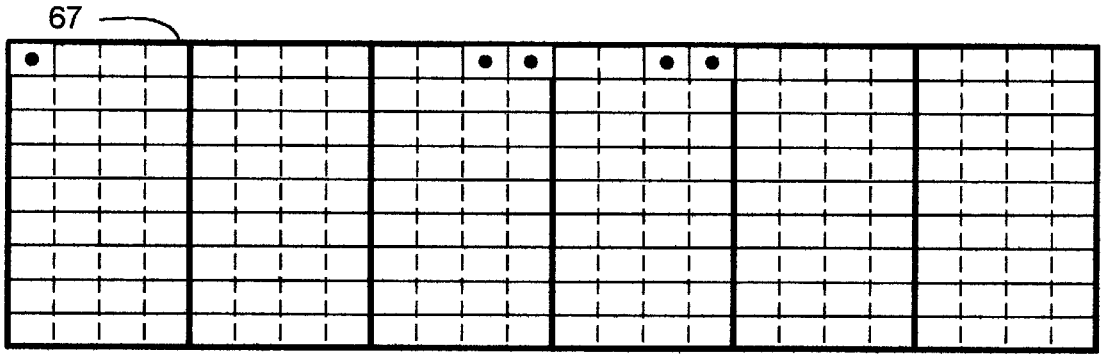
FIGS. 5A–D are views of the display showing the generation of a text string by the graphics system of FIG. 6.
Figure 5B:
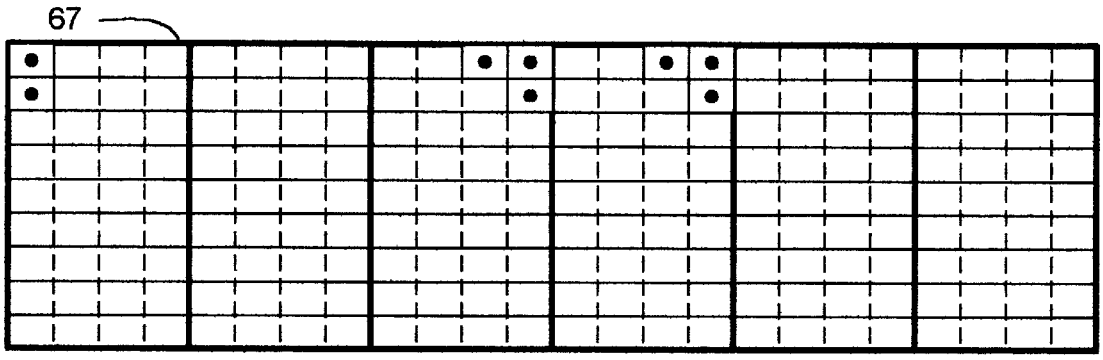
Figure 5C:
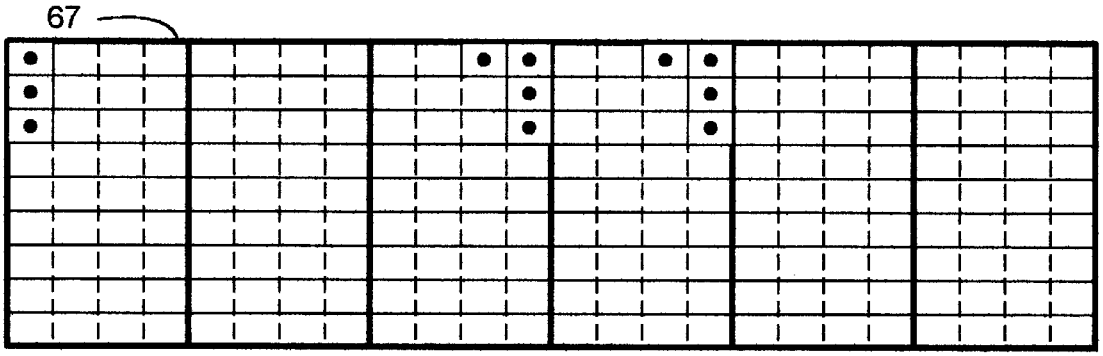
Figure 5D:
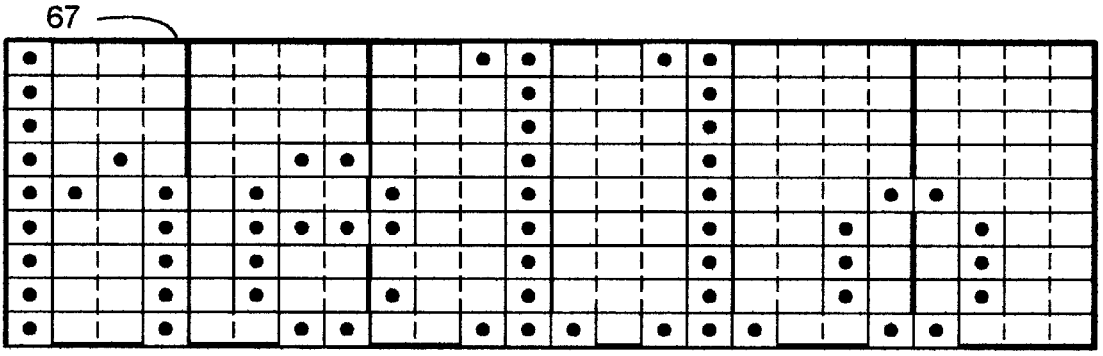
Figure 6:
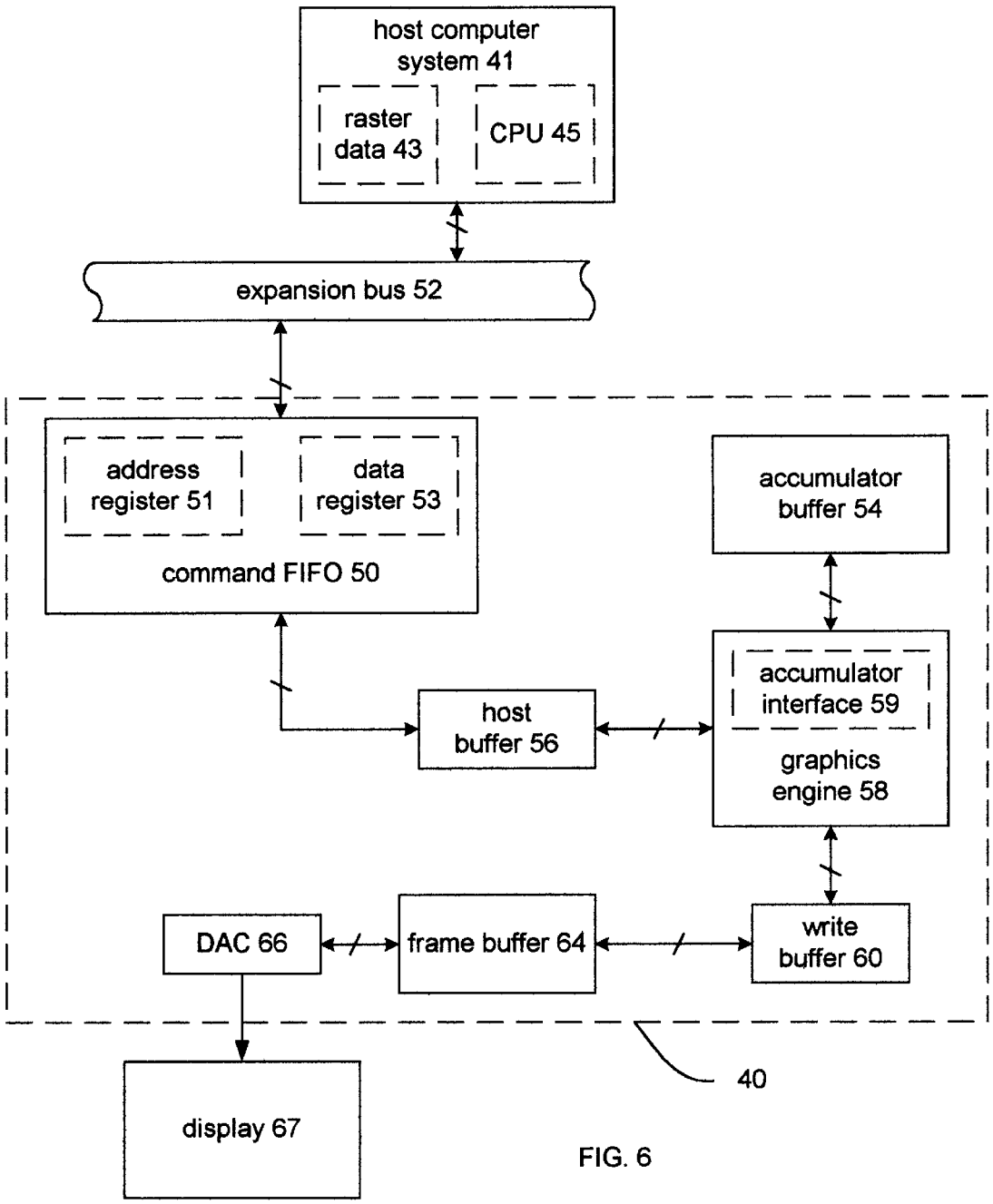
FIG. 6 is a block diagram of a graphics system according to one embodiment of the invention.

As shown in FIGS. 5A–5D and 6, a rasterizer 40 draws a text string on a display 67 one line at time. For example, to draw the text string "hello" having a height of nine pixels (i.e., a height of nine lines), the rasterizer 40 draws the top line of the text string (FIG. 5A) and works downward. After drawing the top line, the rasterizer 40 draws the second text line from the top (FIG. 5B) and then the third line from the top (FIG. 5C). The remaining lines are drawn in this manner until the entire string is drawn on the display 67 (FIG. 5D).

By drawing the text string in this manner, the color values sharing a common page of a frame buffer 64 are grouped together before being transferred to the frame buffer 64. Thus, for every two text lines drawn, the rasterizer 40 stores the associated color values in one page of the frame buffer 64. As a result of this grouping, delays (e.g., page fault delays due to accessing another page) in accessing the frame buffer 64 are reduced, and the rate at which the text string is drawn is maximized. Furthermore, the color values for each of the lines of the text string may be transferred to the frame buffer 64 using burst cycles (a technique that minimizes the number of clock cycles required to transfer data to a contiguous region of memory).

To accomplish this, the rasterizer 40 has an accumulator buffer 54 in which a graphics engine 58 builds a bit mask for the text string. The bit mask is a collection of bits that represents a color pattern for the pixels of the text string. In the bit mask, a bit value of "1" indicates a foreground color value should be transferred to the frame buffer for the associated pixel (i.e., the associated pixel has the foreground color), and a bit value of "0" indicates no foreground color value needs to be transferred to the frame buffer 64 (i.e., the associated pixel has the background color). Once the bit mask is built, the graphics engine 58 uses the bit mask to transfer the foreground color values of each text line to the frame buffer 64. As the color values for each additional text line are written to the frame buffer 64, a digital-to-analog converter (DAC) 66 generates analog signals which cause the additional text line to appear on the display 67.

Raster data 43 defines the foreground pixel pattern of the text string and thus, the bit mask stored in the accumulator buffer 54. A host computer system 41 sends the raster data 43 to the rasterizer 40 in groups, with each group being associated with a character in the text string. The host computer system 41 sends each group in sets of thirty-two bits. Instead of writing the foreground color values associated with each character to the frame buffer 64 as each group of raster data 43 is received, the graphics engine 58 builds the bit mask for the entire text string in the accumulator buffer 54 before transferring any of the color values associated with the text string to the frame buffer 64.

The rasterizer 40 receives the raster data 43 through a command first-in-first-out (FIFO) interface 50 coupled to an expansion bus 52 (e.g., a Peripheral Component Interconnect (PCI) bus). The interface 50 has an address register 51 for storing a thirty-two bit address (the next address coming out of the FIFO) and a data register 53 for storing thirty-two bits (i.e., one Dword) of raster data (the next Dword of raster data coming out of the FIFO). The host computer system 41 writes to predefined addresses (claimed and received by the interface 50) to alert the rasterizer 40 that a text string is being sent, to define the location of the text string on the display 67, and to define attributes (e.g., the foreground color, the width (in pixels) of the characters, and the height (in pixels) of the characters) of the text string.

Figure 7:
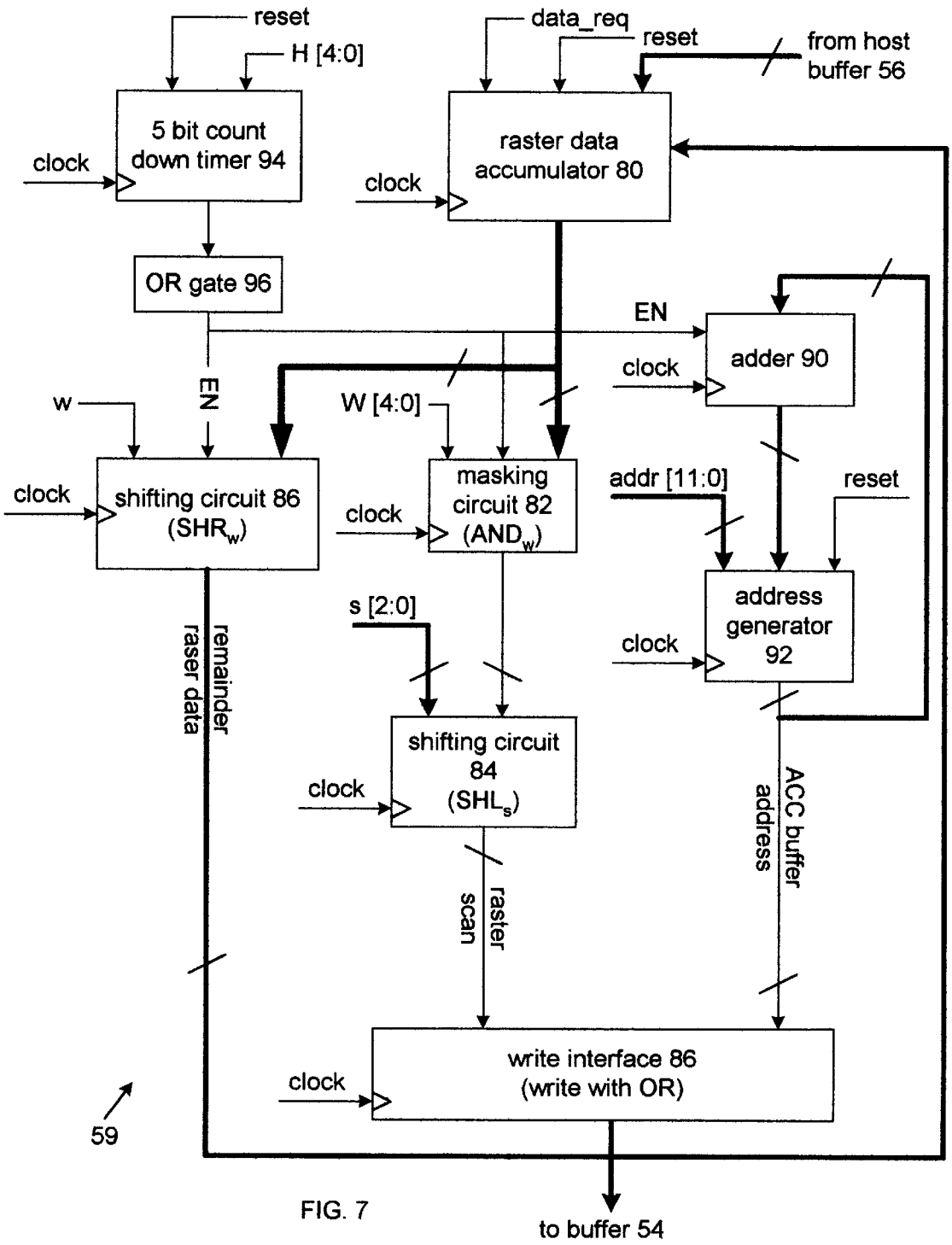
FIG. 7 is a block diagram of an interface to the accumulator buffer of FIG. 6.

The rasterizer 40 also has a host buffer 56 coupled between the interface 50 and the graphics engine 58 for temporarily storing the raster data before the raster data is used to build the bit mask. A write buffer 60 is coupled between the frame buffer 64 and the graphics engine 58. The write buffer 60 provides temporary storage for the color values. The graphics engine 58 also has an accumulator interface 59 which is used to build the mask in the accumulator buffer 54. is As shown in FIG. 7, the interface 59 receives the raster data from the host buffer 56 (in sets of sixty-four bits) and builds the bit mask in the accumulator buffer 54 one character at a time. The interface 59 builds a portion of the bit mask corresponding to one line of the character on each cycle of a clock signal called CLOCK. To accomplish this, the interface 59 has a sixty-four bit accumulator 80 (the bits of which are represented by DATA [63:0]) which stores and manipulates sixty-four bits of raster data received from the host buffer 56 to build a portion of the bit mask associated with one character.

Due to the packing order of the raster data 43, the interface 59 uses the least significant of the bits DATA[63:0] to build a portion of the bit mask associated with one character line. The interface 59 then shifts the bits DATA [63:0] right (with zero padding added to the most significant bits) and uses the resultant least significant bits to build a portion of the bit mask associated with the next vertically adjacent character line of the same character. The interface 59 continues this process until the bit mask has been updated with another character. The interface 59 then undergoes a reset (indicated by a reset signal called RESET) and begins updating the bit mask with another character. When more raster data is needed, the accumulator 80 requests and receives another sixty-four bits of raster data from the host buffer 56.

Figure 8A:
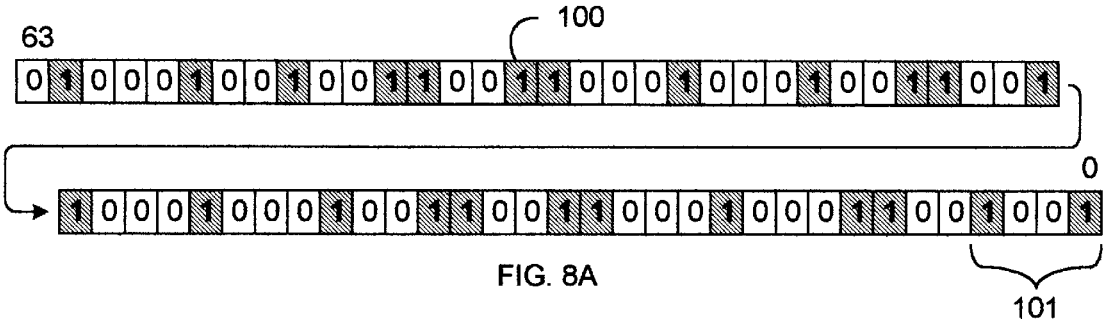
FIGS. 8A–8D are blocks of data illustrating the processing of raster data by the accumulator buffer of FIG. 7.
Figure 8B:
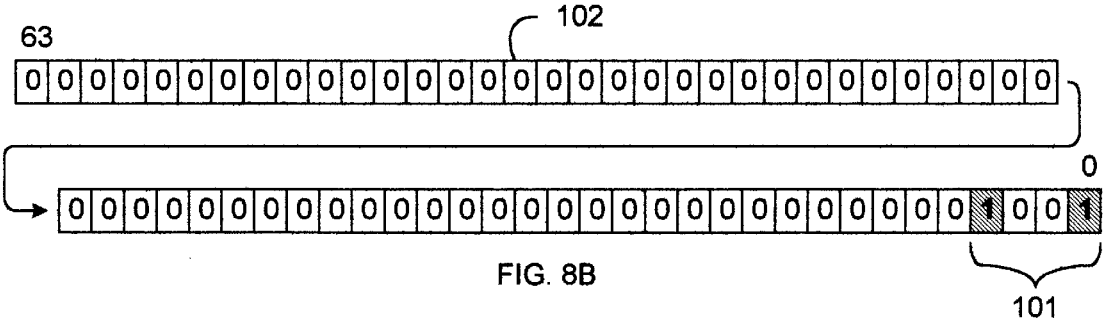
Figure 8C:
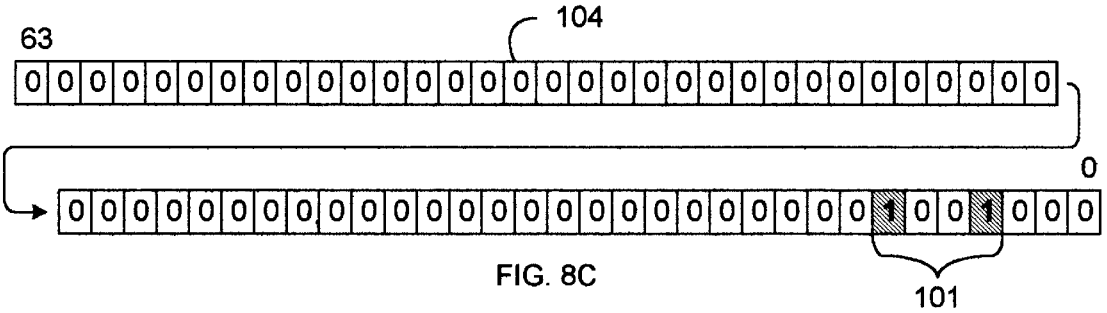

As an example of the processing done by the interface 59 to update the bit mask for one character, the accumulator 80 first receives sixty-four bits 100 of raster data (FIG. 8A) from the host buffer 56. For a character width (represented by a multi-bit signal W[5:0]) of four pixels, the interface 59 uses the four least significant 101 of the bits DATA[63:0] to update the bit mask with one character line. A masking circuit 82 receives the bits DATA[63:0] and masks out (i.e., sets to zero) the sixty most significant bits to form a set of sixty-four bits 102 (FIG. 8B) with the bits 101 being the four least significant. Because the minimum addressable resolution in the buffer 54 is one byte (i.e., eight bits), fine positioning of the bits 101 in the buffer 54 is done via a shifting circuit 84 to align the bits of the bit mask with the pixels on the display 67. The shifting circuit 84 receives the bits 102 and shifts the bits 102 left (with zero padding) zero to seven bits (for this example, three bits) to form shifted bits 104 having the proper position for storage in the buffer 54.

Figure 8D:
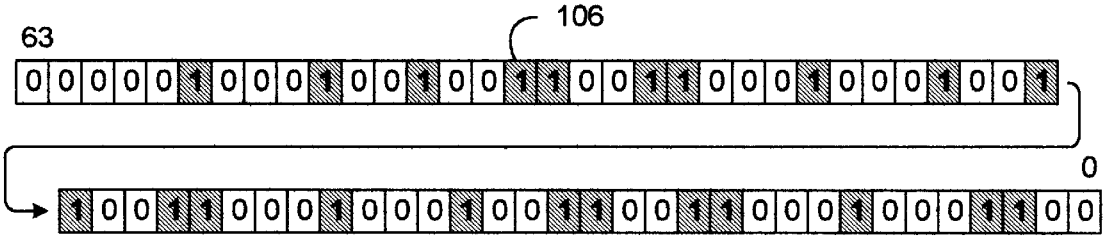

The shifting circuit 84 receives a multi-bit signal S[2:0] which is representative of the number of bit positions that the bits 101 need to be shifted in order to be in proper alignment with the bit mask in the buffer 54. A write interface 86 receives the bits 104, logically Ors the bits 104 with the corresponding bits in the buffer 54, and then writes the resultant Ored bits to the buffer 54. The bits DATA[63:0] are then shifted right (with zero padding added to the most significant bits, as shown in FIG. 8D), and the above-described process is repeated for the next character line.

To perform the shifting of the bits DATA[63:0], the interface 59 has a shifting circuit 88 that shifts the bits DATA[63:0] right (with zero padding added to the most significant bits) by the number of bits indicated by W[4:0]. An address generator 92 furnishes the address of the character line (within the accumulator buffer 54) to the write interface 86. For the first line of the character, the address generator 92 receives the address of the character (represented by an ADDR[11:0]), and after the bit mask for each character line is updated, an adder 90 increments the address furnished to the write interface 86 by 256 bytes (i.e., by one, 1024 pixel line).

For determining when the raster data for a character is being processed, the interface 59 has a five bit decrementing counter 94 which is clocked by the CLOCK signal. When the accumulator 80 begins processing a character (as indicated by the assertion of the RESET signal), the counter 94 is loaded with the height (in pixels, as represented by H[5:0]) of the character. The counter 94 then decrements its output for every cycle of the CLOCK signal (i.e., decrements its output for every character line processed). An OR gate 96 performs a bitwise OR of the output of the counter 94 to furnish an enable signal called EN. When the EN signal is asserted, or driven high, the interface 59 is processing the raster data for a character and the interface circuit 59 is enabled. Otherwise, when the EN signal is deasserted, or low, the interface 59 is disabled.

Figure 9:
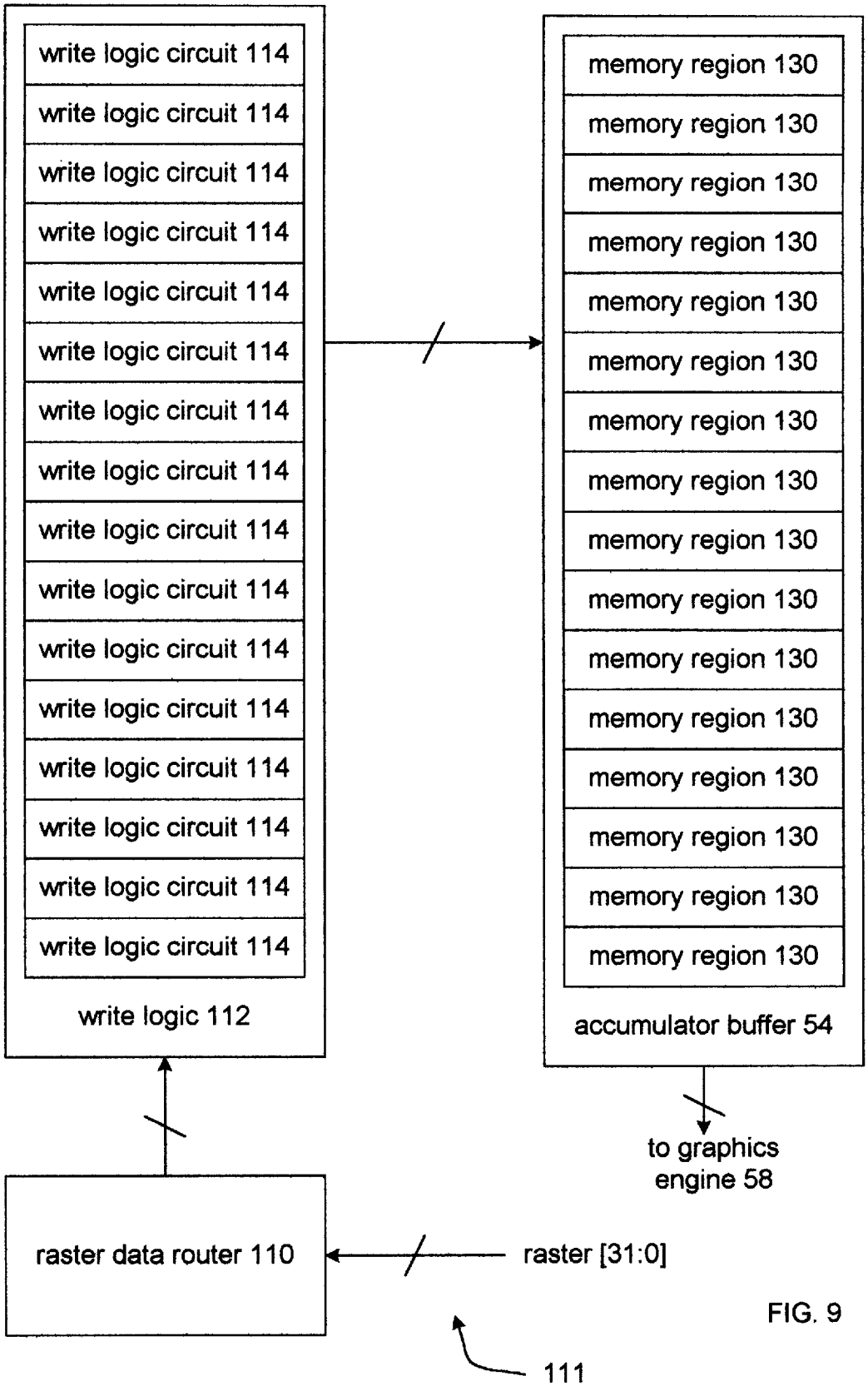
FIG. 9 is a block diagram of another interface to the accumulator buffer for the graphics system of FIG. 6.

As shown in FIG. 9, the interface 59 may be replaced with another accumulator buffer interface 111 that also updates the bit mask one character at a time. However, the accumulator buffer interface 111 is capable of concurrently updating more than one character line during each cycle of the CLOCK signal. To accomplish this, the interface 111 has a raster data router 110 that receives the raster data from the host buffer 56 thirty-two bits (represented by the its RASTER[31:0]) at a time. The bits RASTER[31:0] may contain the raster data for more than one character line.

The router 110 extracts the raster data from the bits RASTER[31:0], and write logic 112 updates an associated memory region 130 in the accumulator buffer 54. Each region 130 contains the color values for an associated horizontal scan line (i.e., 1024 pixels or 256 bytes). As an example, if the bits RASTER[31:0] contain the raster data for a character having a width of four pixels and a character height of eight pixels (i.e., represented by 32 bits of raster data), the bit mask is updated with the character in one cycle of the CLOCK signal. The write logic 112 has a write logic circuit 114 associated with each memory region 130 of the frame buffer 64. Thus, on each cycle of the CLOCK signal, each write logic circuit 114 updates the associated region 130 if raster data for that region is contained within the bits RASTER[31:0].

Figure 10:
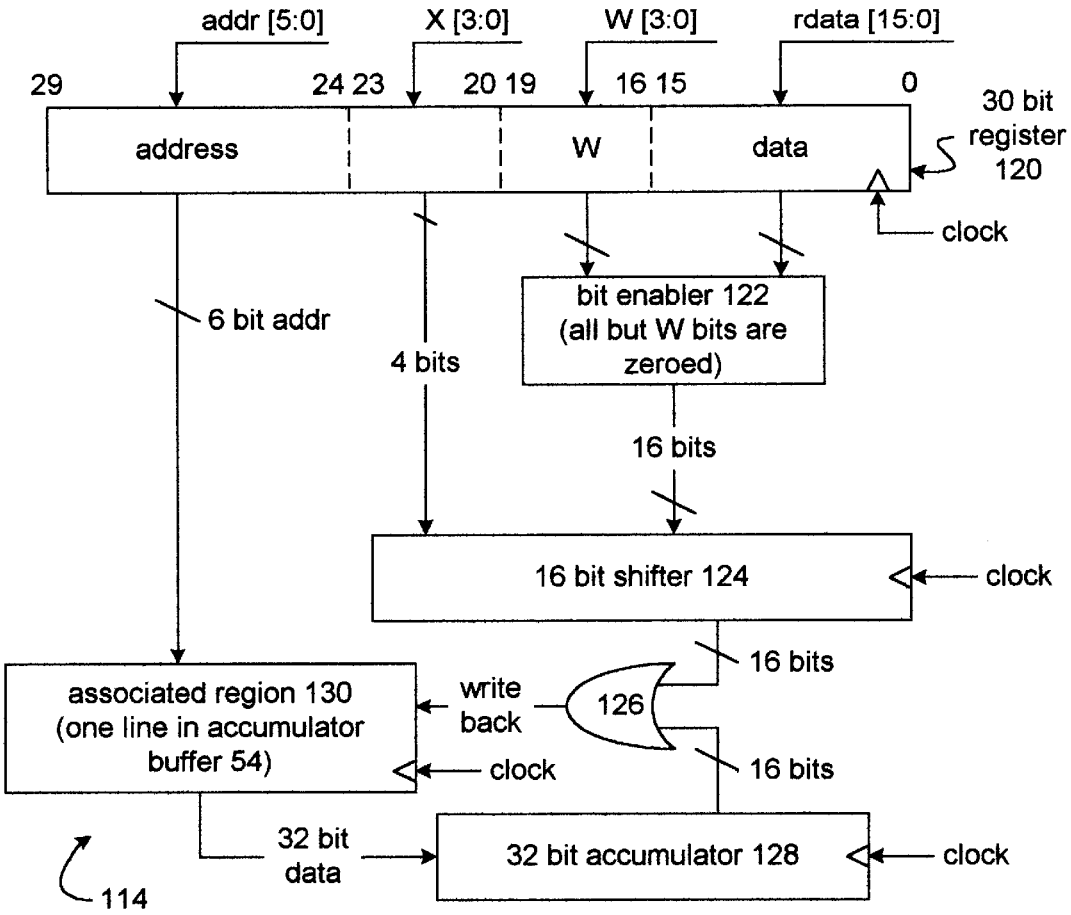
FIG. 10 is a block diagram of the write logic of FIG. 9.

As shown in FIG. 10, each write logic circuit 114 has a thirty bit register 120 which stores the address (bits 20–29) and width (bits 16–19) of the characters in the text string. The address specifies the pixel address in an associated scan line. The six most significant bits of the address (represented by ADDR[5:0]) point to a Dword in the region 130, and the four least significant bits of the address (represented by X[3:0]) point to a bit offset in that Dword. Bits 0–15 of the register 120 store the raster data for the associated region 130. A bit enabler 122 receives the width of the character and the raster data from the register 120. Based on the width of the character, the bit enabler 122 clears the raster bits that do not contain raster data for the associated region 130 and sends the resultant output to a sixteen bit shifter 124.

The shifter 124 shifts the bits received from the bit enabler 124 by the value represented by X[3:0] and furnishes the resultant output to one input of a multi-bit OR gate 126. The OR gate 126 receives the current contents of the addressed located in the region (i.e., the word pointed to by ADDR [5:0]) from a thirty-two bit accumulator 128. The output of the OR gate 126 is furnished to the region 130 at the location pointed to by ADDR[5:0].

Figure 11:
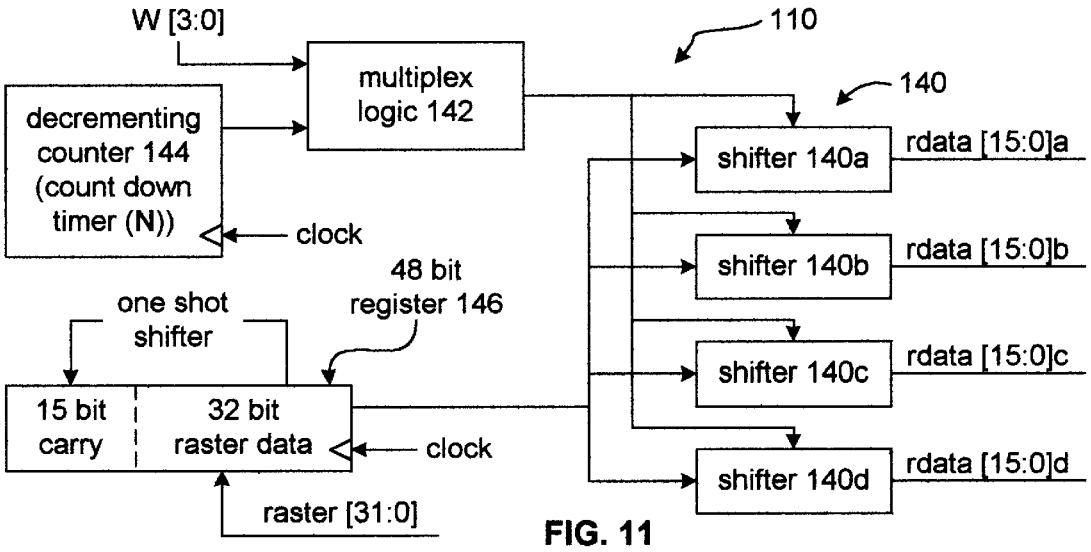
FIG. 11 is a block diagram of the raster data routing logic of FIG. 9.

As shown in FIG. 11, the router 110 has a forty-eight bit register 146 in which the thirty-two least significant bits receive the bits RASTER[31:0] from the interface 110 on each cycle of the CLOCK signal. By using a one shot shifter, the sixteen most significant bits of the register 146 are used to hold a carry over of bits 16–31 of the register. The sixteen most significant bits are used when some of the raster data in the bits 0–31 did not fill up a character line on the last clock cycle. For example, for a character width of 6 pixels, the bits RASTER[31:0] define five character lines. One bit (bit 31) is leftover and used during on the next cycle of the CLOCK signal when the remaining five bits of raster data are present in the bits 0–4.

A decrementing counter 144 is used to track the amount of raster data (in thirty-two bit sets) that are received by the router 110. In this manner, the router 110 tracks the current character lines represented by the bits RASTER[31:0]. For example, for a character width of eight pixels and a character height of eight pixels, the first set of bits RASTER[31:0] contains the information for lines 0–3 of the character, and the next set of bits RASTER[31:0] contains the information for lines 4–7.

The output of the counter 144 is received by multiplex logic 142 which also receives the bits W[3:0]. Based on the width of the character and the output of the counter 144, the multiplex logic 142 determines the lines 130 that need to be updated and selects the bits in the register 146 that need to be routed to these lines 130. The multiplex logic 142 communicates this information to shifters 140 (one for each line 130). The shifters 140 selectively route the bits from the register 146 to the bits 0–15 of the registers 120.

Other embodiments are within the scope of the following claims.

What is claimed is:

1. A rasterizer comprising:

a command FIFO operably coupled to receive raster data of a character of a text string from a host computer system, wherein the raster data includes at least color values. character width, and character height of the character;

a host buffer operably coupled to the command FIFO, wherein the host buffer temporarily stores the raster data for each character of the text string;

a write buffer operably coupled to temporarily store the color values for each character of the text string; and a graphics engine operably coupled to the host buffer, wherein the graphics engine generates a bit mask for the text string from the raster data stored in the host buffer, wherein the bit mask represents a color pattern for pixels of the text string, wherein the graphics engine causes, based on the bit mask, at least some of the color values stored in the write buffer to be written, on a scan line by scan line basis, to a frame buffer after the bit mask has been generated.

2. The rasterizer of claim 1 further comprises an accumulator buffer operably coupled to the graphics engine, wherein the accumulator buffer temporarily stores the bit mask as the graphics engine generates the bit mask.

3. The rasterizer of claim 2 wherein the graphics engine further comprises an accumulator interface operably coupled to the accumulator buffer, wherein the accumulator interface builds a portion of the bit mask corresponding to one line of the character each cycle of a clock signal.

4. A method for use with a system that furnishing raster data representative of a string of characters to be formed on a display, the method comprising:

receiving the raster data of a character of the string of characters from the system, wherein the raster data includes at least color values, character width, and character height of the character;

temporarily storing the raster data for each character of the string of characters to produce stored raster data;

temporarily storing the color values for each character of the string of characters to produce stored color values;

generating a bit mask for the string of characters from the stored raster data, wherein the bit mask represents a color pattern for pixels of the string of characters;

providing, based on the bit mask, at least some of the stored color values, on a scan line by scan line basis, to a frame buffer after the bit mask has been generated.

5. The method of claim 4 further comprises temporarily storing the bit mask as the bit mask is being generated.

6. The method of claim 4 further comprises building a portion of the bit mask corresponding to one line of the character each cycle of a clock signal.

* * * * *